US005123360A

United States Patent [19]

Burke et al.

[11] Patent Number: 5,123,360

[45] Date of Patent: Jun. 23, 1992

[54] PELLET STOVE WITH ENHANCED AIR CIRCULATION EFFICIENCY

[76] Inventors: Terrence M. Burke; William L. Burke, 7110 21st Ave., Sacramento, Calif. 95820

[21] Appl. No.: 815,635

[22] Filed: Dec. 30, 1991

Related U.S. Application Data

[63] Continuation of Ser. No. 662,493, Feb. 27, 1991, abandoned, which is a continuation of Ser. No. 446,878, Dec. 6, 1989, abandoned.

[51] Int. Cl.[5] ..... F23B 7/00

[52] U.S. Cl. ..... 110/233; 110/102; 110/110; 126/61; 126/67; 126/68; 126/73; 126/77; 126/79

[58] Field of Search ..... 110/193, 110, 102, 233; 126/61, 79, 67, 68, 73, 77

[56] References Cited

U.S. PATENT DOCUMENTS

| | | | |
|---|---|---|---|
| 8,685 | 1/1852 | Hayes . | |
| 41,645 | 2/1864 | Sholl . | |
| 120,439 | 10/1871 | House . | |
| 268,921 | 12/1882 | Metzner . | |
| 392,462 | 11/1888 | Savage . | |
| 1,139,857 | 5/1915 | Garey . | |
| 1,914,486 | 6/1933 | Burton . | |
| 2,014,171 | 9/1935 | Fischel . | |
| 2,067,583 | 1/1937 | Stark . | |
| 2,121,273 | 6/1938 | Uhl et al. . | |
| 2,220,414 | 11/1940 | Kirtzer . | |
| 2,315,070 | 3/1943 | McNaughton . | |
| 2,377,356 | 6/1945 | Miller . | |
| 2,533,330 | 12/1950 | Schweickart et al. . | |
| 2,584,235 | 2/1952 | Skelly . | |
| 2,689,560 | 9/1954 | Johnson . | |
| 4,261,326 | 4/1981 | Ihlenfield . | |
| 4,351,315 | 9/1982 | Babbage . | |
| 4,430,949 | 2/1984 | Ekenberg | 110/110 X |
| 4,454,828 | 6/1984 | Zempel . | |
| 4,517,903 | 5/1985 | Richmond et al. . | |
| 4,565,184 | 1/1986 | Collins et al. . | |
| 4,619,209 | 10/1986 | Traeger et al. | 110/110 |
| 4,669,396 | 6/1987 | Resh . | |
| 4,782,765 | 11/1988 | Miller et al. . | |
| 4,787,322 | 11/1988 | Whitfield . | |

FOREIGN PATENT DOCUMENTS

| | | |
|---|---|---|
| 46339 | 5/1888 | Fed. Rep. of Germany . |
| N1076708 | 4/1954 | France . |

*Primary Examiner*—Edward G. Favors
*Attorney, Agent, or Firm*—David Pressman

[57] ABSTRACT

A pellet stove has an arrangement for improving the flow of air therethrough. Air entering the stove is split into first and second portions. The first portion is diverted upwardly through a combustion chamber, wherein pellets are burned, thereby aiding in the burning of the pellets. The first portion of air then exits from the combustion chamber. It is directed to a rear of the stove through a heat exchanger where a flue exhaust is located. The second portion of air has three parts. The second portion of air is simultaneously diverted upwardly around the hopper and auger mechanisms, whereby the mechanisms and the pellets therein are cooled. One part of the second portion of air then is received in the flue exhaust so that this one part of the second portion of air exits the stove, creating a negative pressure in the combustion chamber. This negative pressure creates a push-pull system effect that improves the draft and pulls the flow of the first portion of air through the combustion chamber wherein the pellets are efficiently burned. Another second part of the second portion of air is heated over the combustions area's top wall and via heat exchange near the exhaust gas from the first portion. This remainder of heated fresh air is fed into the room. A final third part of the second portion is pushed into the combustion chamber via the auger feed mechanism, precluding heat build-up. The improved air flow permits the device to utilize only one circulation fan. Unique circuitry allows virtually any power source to be used.

5 Claims, 3 Drawing Sheets

PELLET STOVE WITH ENHANCED AIR CIRCULATION EFFICIENCY

This application is a continuation of Ser. No. 07/662,493 filed Feb. 27, 1991 abandoned, and which is a continuation of 07/446,878 filed Dec. 6, 1989 abandoned.

BACKGROUND

1. Field of the Invention

This invention relates to pellet stoves, in particular to the circulation of air within such stoves to enhance combustion therein.

2. Prior Art

Pellet burners and stoves are very well known in the art. Because of certain advantages over wood-burning stoves, such as reduced emissions and greater heat exchange, there is a great interest in producing as efficient a pellet burner or stove as possible.

Of particular interest in most pellet stoves is the improvement and efficiency of the circulation of air therethrough, so as to improve the heat transfer through its heat exchanger and into the room. This improved air flow also provides for a more efficient burning of the fuel pellets therein. Further, there has been a long standing requirement for a pellet-burning stove capable of operating for an extended period of time on a backup battery.

OBJECTS OF THE INVENTION

Accordingly, one object of the invention is to provide a pellet stove that has an arrangement which provides for an improved circulation of air flow therethrough.

Other objects are to so improve the flow of air through the stove so that only one fan is needed, for providing the air circulation needed to provide a stove which requires only a single, low-power direct-current fan to move air throughout the stove, permitting a large reduction in the electrical power requirements of the stove and thus permitting operation for many hours in battery backup mode, to provide a stove which provides a safe natural draft to exhaust noxious and combustible gases from the combustion chamber, even if the power to the air circulation fan is lost, thereby to prevent a possibly explosive condition developing in the combustion chamber, to provide a stove which provides a highly efficient heat exchanger placed in the path of the natural draft and permits a maximum amount of heat in the exhaust gases to transfer to the air into the room, to provide a pellet stove having such an arrangement which is simple, relatively inexpensive to fabricate, and easy to scale up or down in size and capacity because of its less complex structure, to provide a stove wherein heated air circulating therethrough is utilized to heat a cooking surface on the stove, and to provide a stove which allows access to the inside of the heat exchanger, permitting easy cleaning of the heat exchanger.

Still another object is to provide a pellet stove including a hopper for receiving pellets, a combustion area partitioned from the hopper, an auger for feeding pellets to the combustion area from the hopper, an air inlet directing air into the stove first to the fuel storage area, means for diverting a portion of air in the fuel storage area into the combustion area, and control means for regulating the auger and its feeding into the combustion area.

Yet another object is to provide a method for burning fuel pellets in a stove comprising segregating the stove into a combustion area and a fuel storage area, pressurizing the fuel storage area with air, diverting a portion of the air into the combustion area, directing a further, larger portion of the air from the fuel storage area to an exhaust flue, and exhausting combustion gases from the combustion area to the exhaust flue, thereby providing a push-pull effect.

These and still further objects will become apparent from a reading of the following specification, taken in conjunction with the enclosed drawings.

SUMMARY

In accordance with the invention, a pellet stove has an arrangement that provides for an improved flow of air therethrough. This stove includes a back wall with an air inlet and a top wall having a flue exhaust outlet. A pellet fuel hopper in the stove receives fuel pellets to be burned. In this manner, fuel pellets may be stored before being fed to a combustion chamber of the stove for use as fuel.

The hopper is rearward of the combustion chamber and substantially adjacent to the back wall. The hopper is further located above the air inlet formed in the back wall and below the flue exhaust outlet formed in the top wall of the stove. An auger feed mechanism is encased between and operatively associated with the pellet hopper and the combustion chamber's fire pot for receiving the pellets from the hopper and for feeding the pellets to the fire pot.

The combustion chamber is located forwardly of the pellet hopper and is isolated therefrom. The combustion chamber includes the fire pot, wherein pellets are received and burned. The fire pot includes a bottom in which a plurality of air inlet vents are formed. Through the vents, air may be received in and vented upwardly through the fire pot providing oxygen for burning the pellets. The combustion chamber further includes a top and extending therefrom to the back wall of the stove is a heat exchanger. The rear of the top wall of the heat exchanger has an exhaust gas flue formed therein within which is formed a draft enhancing pipe extending down through the bottom wall of the heat exchanger. In this fashion, air that has passed upwardly through the fire pot may exit from the combustion chamber as exhaust gas and beyond the top wall heat exchanger, with the gas being pulled into the flue because of the natural draft, forced air entering the combustion chamber from the fuel storage area and the draft enhancing pipe.

Air entering the stove by the air inlet creates a positive air pressure within the fuel storage area which houses the pellet hopper, auger mechanism, and control system. From this pressurized enclosure the air entering the stove is separated into first and second portions. The first portion is directed into the combustion chamber via the air vents in the fire pot seated in the lower portion of the combustion chamber. The first portion of air is pushed upwardly through the fire pot, so as to aid in the burning of pellets. The first portion of air then continues upwardly through the combustion chamber laterally through the heat exchanger, and exiting via the opening formed in the top of the heat exchanger.

The second portion of air is directed upwardly around the hopper and auger mechanism, cooling them. A first part of the second portion then continues upwardly, exiting the fuel storage area through not only vent holes into the central heat exchanger pipe for carrying room air, but also an air manifold connecting with the remaining heat exchanger pipes for carrying room air which is gaining heat. The room air is then pushed into the room. A second remaining part of the second portion exhausts to a flue which assists in pulling air and exhaust gases from the combustion box. All of the first portion and the first part of the second air portion are received in the heat exchanger exhaust passage and the heat exchanger room air pipes. The second remaining part of the second portion of air exits the exhaust flue via the draft enhancing pipe, creating a negative pressure in the heat exchange passage and the combustion chamber, thereby assisting the natural draft in pulling the first portion of air rearward through the heat exchanger and out the flue exhaust. In this manner, a push-pull system effect is created which increases the draft in the fire pot for a more efficient burning of the pellets.

Note that the heat exchanger does not commingle the first air portion with the first part of the second air portion. Rather, the first portion of air heats the first part of the second portion of air before it is pushed into the room.

By forming the stove's outer shell as an air pressurized "vessel", a single, efficient fan performs what heretofore required several fans and a maze of duct work. The fan pushes the air into two paths: a first air portion which enters the combustion area and a second portion which is further divided: one part goes to the exhaust flue which communicates with the heat exchanger. This assists the natural draft in pulling the gases from the combustion chamber. A remaining part of the second portion is heated via a heat exchanger over the combustion chamber and then is pushed into the room.

STOVE'S MECHANICAL STRUCTURE

Figure 1:
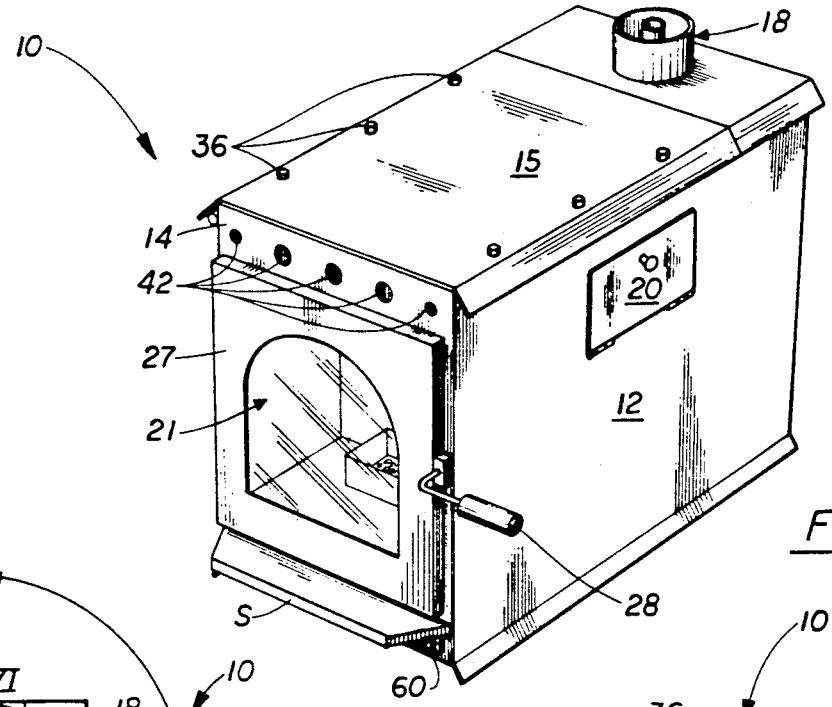
FIG. 1 is a perspective view of the pellet stove of the present invention.

A pellet stove 10 (FIGS. 2, 3) of the invention includes a bottom wall base 11, a pair of opposite side walls 12, a back wall 13, a front wall 14, and a top wall 15.

Figure 3:
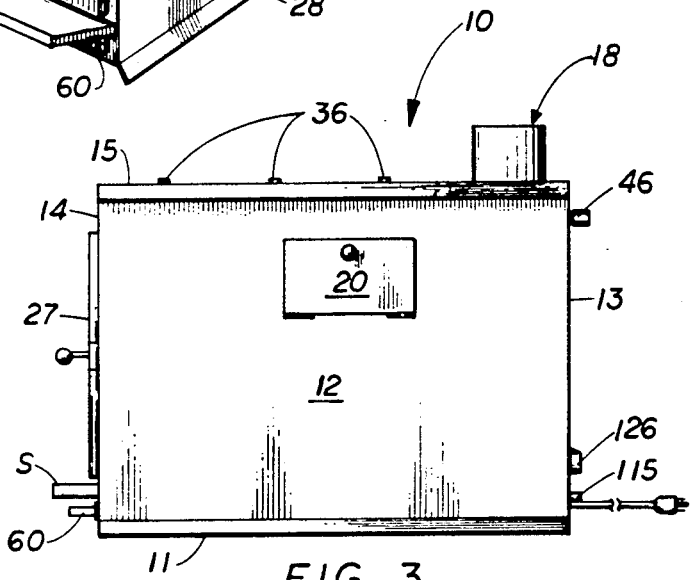
FIG. 3 is a side view of the pellet stove of FIG. 1.
Figure 4:
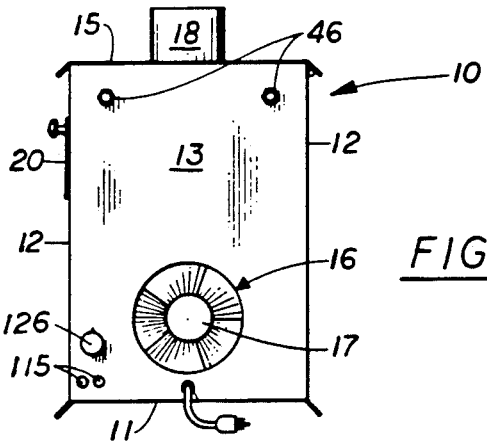
FIG. 4 is a rear view of the pellet stove of FIG. 1.
Figure 6:
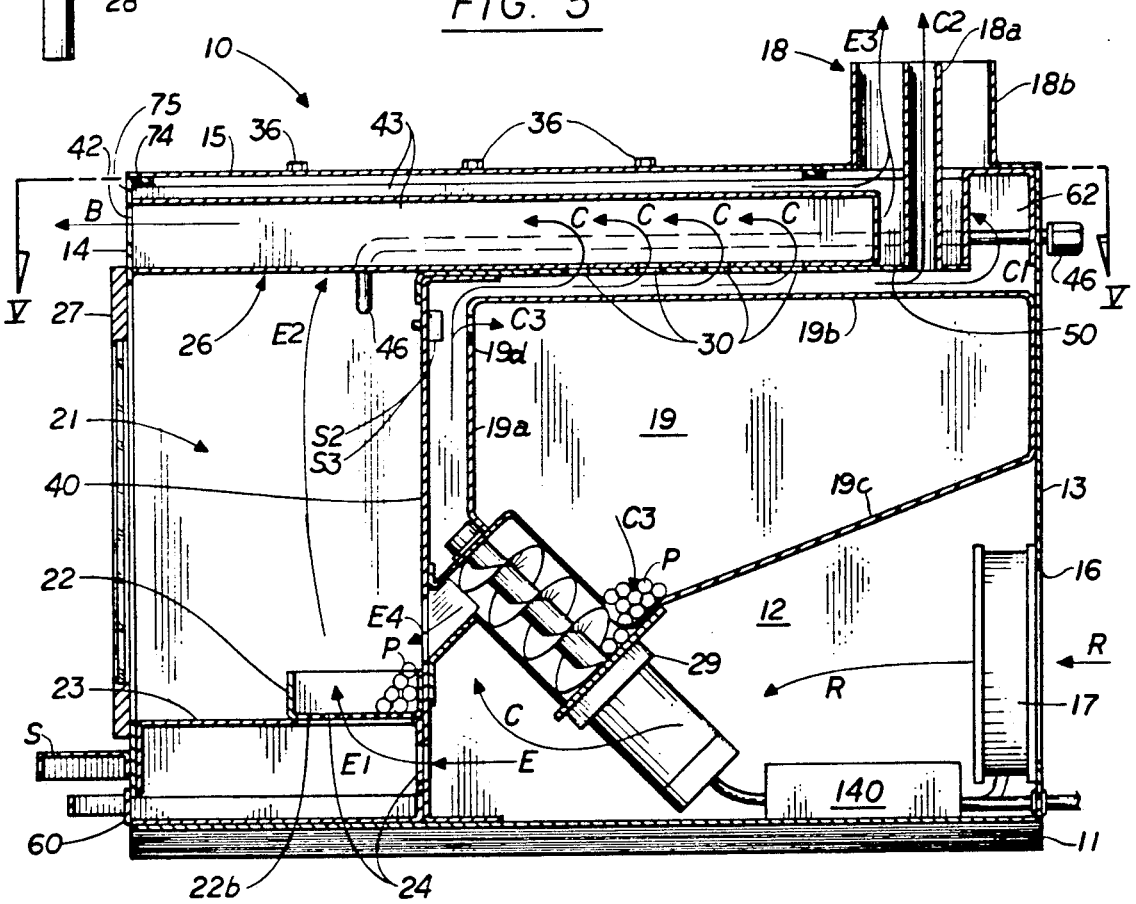
FIG. 6 is another section view of the pellet stove taken along lines VI—VI of FIG. 2.

Back wall 13 (FIG. 3) has a flue inlet 16. Inlet 16 permits air from the ambient environment to enter the stove for use therein. Carried on back wall 13, so as to be disposed over flue inlet 16, is an intake and circulation fan 17 (FIGS. 4, 6). Fan 17 aids in drawing air into the stove and in the circulation (blowing) of air within stove 10 along arrow R (FIG. 6), as shall be discussed.

Formed in top wall 15, rearward toward back wall 13, is a flue exhaust outlet 18. Preferably outlet 18 is in the form of a flue or chimney for aiding in drawing air. Outlet 18 (FIG. 1) permits the exhaust air within the stove to exit. Outlet 18 has two portions: an inner sleeve 18A (FIGS. 5, 6) and a concentric outer sleeve **18*b* (FIG. 6**).

Figure 2:
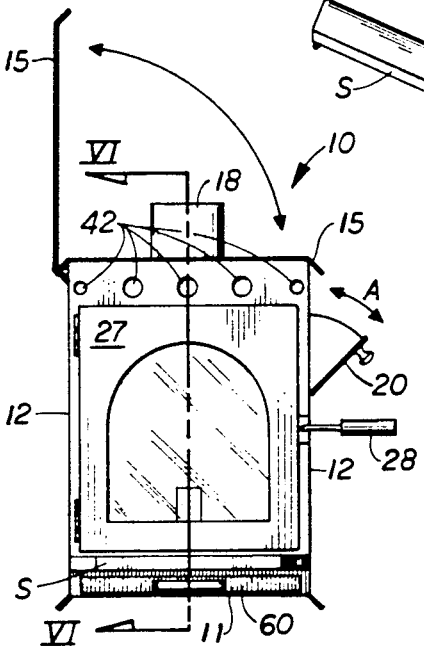
FIG. 2 is a front view of the pellet stove of FIG. 1.

A pellet feed hopper 19 (FIG. 6) is disposed in the stove for receiving fuel pellets P (FIG. 6) to be burned. The pellets may be placed into hopper 19 via a door 20 (FIGS. 1, 2, 3, 4) that is formed in one of side walls 12 for this purpose. Door 20 may be in the form of a chute or funnel for guiding the pellets into hopper 19. Access to the interior of hopper 19 is achieved by moving the door in the direction of arrow "A" (FIG. 2).

Pellets are stored in hopper 19 for subsequent feeding to a combustion chamber 21 (FIG. 6) for use therein as a fuel. Hopper 19 is positioned substantially adjacent to back wall 13 so as to be isolated (and insulated) as much as possible from forwardly located combustion chamber 21. The hopper includes a front wall **19*a* (FIG. 6) and a top wall 19*b* (FIG. 6) in addition to its trough shaped lower wall 19*c* (FIG. 6). Top wall 19*b* isolates the hopper from outlet sleeve 18*a*. Note that top wall 19*a* includes air passageways 19*d* (FIG. 6) near the top wall 19*a*. Disposed thusly, hopper 19 is located above inlet 16 formed in back wall 13 and below exhaust outlet 18**.

Combustion chamber 21 is located in the stove forwardly of hopper 19 and, as noted above, isolated and insulated therefrom. Chamber 21 includes a floor 23 (FIG. 6) and a fire pot 22 (FIGS. 5, 6) where fuel is received and burned. Fire pot 22 includes a bottom **22*b* (FIG. 6) that has a plurality of air inlet vents 24 (FIG. 6). Vents 24 permit air to be received in and vented upwardly, along arrow E1 (FIG. 6), through fire pot 22 and chamber 21 for burning the pellets in pot 22**.

Figure 5:
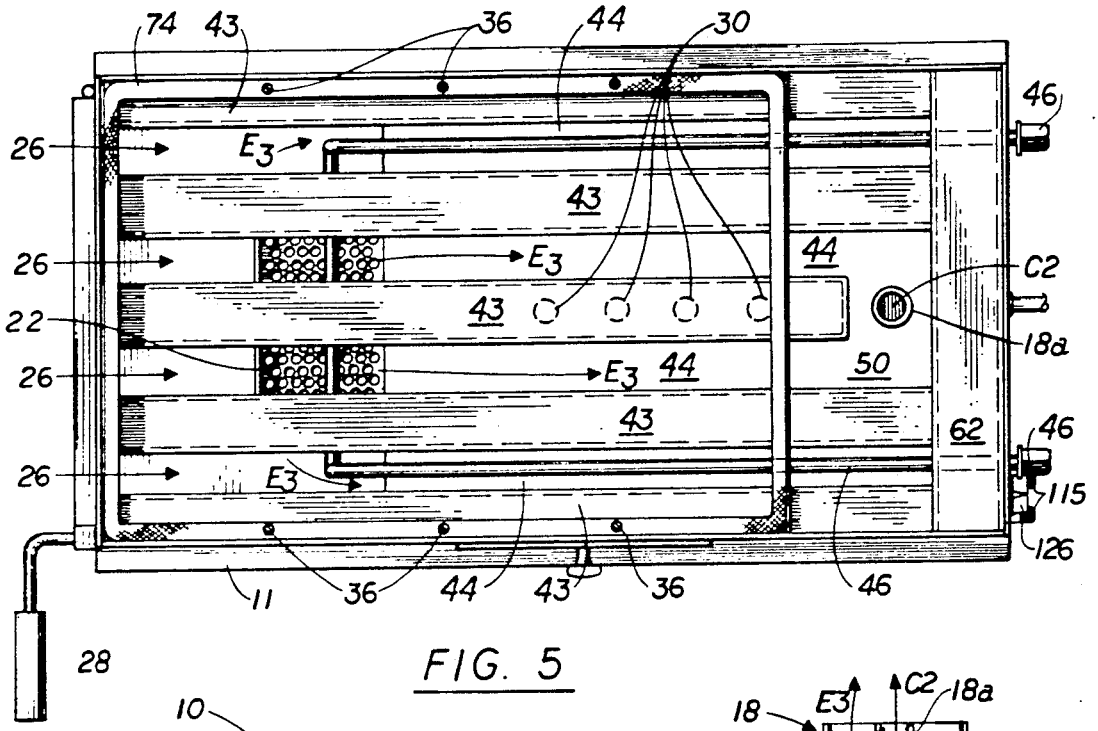
FIG. 5 is a cross-section view of the pellet stove taken along lines V—V of FIG. 6.

Chamber 21 further includes an opening that defines an air and exhaust gas outlet vent 26 (FIGS. 5, 6). Vent 26 preferably is located substantially above fire pot 22. In this fashion, air and combustion gases that have passed upwardly through pot 22 may exit from chamber 21 via vent 26 along arrow E2 (FIG. 6). FIGS. 5 and 6 show the exhaust gases passing to flue **18*b*, as per arrows E3 via passage 44**.

Preferably, chamber 21 also has an operable door 27. Door 27 is openable and closeable by the use of handle 28 (FIGS. 1, 2, 5). Door 27 provides access to chamber 21, including pot 22, to empty pot 22. Also, an ash pan 60 (FIGS. 1, 2, 3, 6) is placed below pot 22. Pan 60 operates like a drawer, opening on front wall 14 for cleaning. An ash shelf S (FIGS. 1, 2, 3, 6) projects forwardly from front wall 14, below door 27 and above pan 60.

FUEL FEED MECHANISM

Disposed between hopper 19 and chamber 21 is an auger feed mechanism 29 (FIG. 6). Mechanism 29 is operatively associated with hopper 19, so as to receive pellets therefrom, for example, by the use of gravity. Mechanism 29 is further operatively associated with chamber 21, so that pellets received in the mechanism are fed therefrom to pot 22 in chamber 21. Mechanism 29 elevates and advances the pellets forwardly to chamber 21 where a chute drops them into pot 22. The chute passes through a wall 40 (FIG. 6) which separates chamber 21 from hopper 19.

AIR PASSAGEWAYS

A top wall 50 (FIGS. 5, 6) closes off the stove's fuel storage area. A central portion of wall 50 has fresh air vent passages 30 (FIGS. 5, 6). Passages 30 extend linearly along wall 50 to allow air passing therethrough to be heated via contact over combustion area vent 26 and exhaust passages 44 (FIG. 5). The heated air is discharged forwardly of the stove via outlets 42 (FIGS. 1, 2, 6) as per arrows B (FIG. 6) into the room. The fresh air is not mingled with combustion gases. It is isolated therefrom and passes into the room via conduit 43 (FIGS. 5, 6). Other conduits 43, parallel to central conduit 43 receive fresh air from a manifold 62 (FIGS. 5, 6) disposed at the juncture of rear wall 13 and top wall 15. Heated fresh air "B" from the fuel storage area passes to the room and is fed via manifold 62 through conduits 42 shown by arrows "C1" (FIG. 6).

Arranged in the manner noted above, air (arrow R) entering stove 10 by inlet 16 formed in back wall 13 is separated into a first portion E (FIG. 6) and a second portion C at a position located rearward of, and remote from, chamber 21.

The first portion E of air enters chamber 21 through air inlet vents 24 (FIG. 6) formed in wall 40, floor 23, and in bottom 22*b* of pot 22, as shown by arrow E1. The air then passes substantially upwardly through pot 22 and chamber 21 thereabove (arrow E2) and then exits from chamber 21 via vent 26 formed in the opening of chamber 21. This upward flow of first portion E1 of air feeds and aids in the burning of pellets in pot 22. E2 is ultimately exhausted via flue 18*b* (E3) by passing from outlet vent 26 through passages 44. Additional air E4 (FIG. 6) is forced into combustion area 21 through the chute of auger 29 to reduce the temperature in hopper 19 and aid combustion.

The second portion C of air is diverted upwardly, wherein it passes around and cools hopper 19 and auger mechanism 29, as well as the pellets. As mentioned, some of air E4 enters the fire pot area via the chute that delivers the pellets P. Note that E4 air first enters the enclosure defining hopper 19 via passageways 19*d* (FIG. 6) as arrow C3 (FIG. 6).

This second portion of air C has another component C1 (FIG. 6) which then continues upwardly through outlet vent holes 30 formed in top wall 50 (FIG. 5) above hopper 19 and is diverted forwardly to outlet 42 via conduit 43. A further component C1 passes through a manifold 62 located at the corner of top wall 15 and rear wall 13. This air recombines with the air in the room (arrow B in FIG. 6), which had passed through holes 30. Thus, air is heated and discharged into the room via outlets 42.

A remainder C2 (FIGS. 5, 6) of the second portion C of air exits via flue exhaust 18*a*. This air C2 pulls first portion E3 of air from passage 44 and vent 26 rearward towards and out of flue exhaust 18*b*. The first and second portions of air mix upstream in flue exhaust 18. Besides providing positive air flow by pulling air through chamber 21, the exhaust gases are cooled and diluted by mixing with air in flue 18. This causes reduced particle and pollutant emission because the hot exhaust gases are oxidized further in flue 18.

This flow of air provided by the above described arrangement creates a pressure gradient in chamber 21. This pressure differential results in a push-pull effect which precisely meters the flow of the first portion of air through chamber 21. This provides a better draft and a more efficient burning of the pellets in pot 22. Specifically, the fuel storage area is at a higher pressure than the combustion area. This "pressurization" forces air into the combustion chamber both at inlet 24 and to a certain extent through the pellet chute. Exhaust gas is pulled from the flue, creating the push-pull effect. Mixing of air with the exhaust gases in flue 18 completes the combustion process.

Preferably, top wall 15 of the stove can serve as a cooking surface. Heat from combustion carried by the first and second portions of air passing between walls 15 and 50 provides the heat necessary for cooking on the outer surface of top wall 15. Wall 15 is pivotally secured to the stove by a hinge so as to be removably disposed over passageways 44, fresh air manifold 62, and heated fresh air conduits 43. This exposes passageways 44 for cleaning. A gasket 74 (FIGS. 5, 6) and bolts 36 (FIGS. 1, 3, 5, 6) seal top wall 15 to the stove. Note that outboard conduits 43 define a shelf supporting the gasket longitudinally, and a shelf 75 (FIG. 6) supports the gasket latitudinally.

ELECTRIC CIRCUITRY

Figure 7:
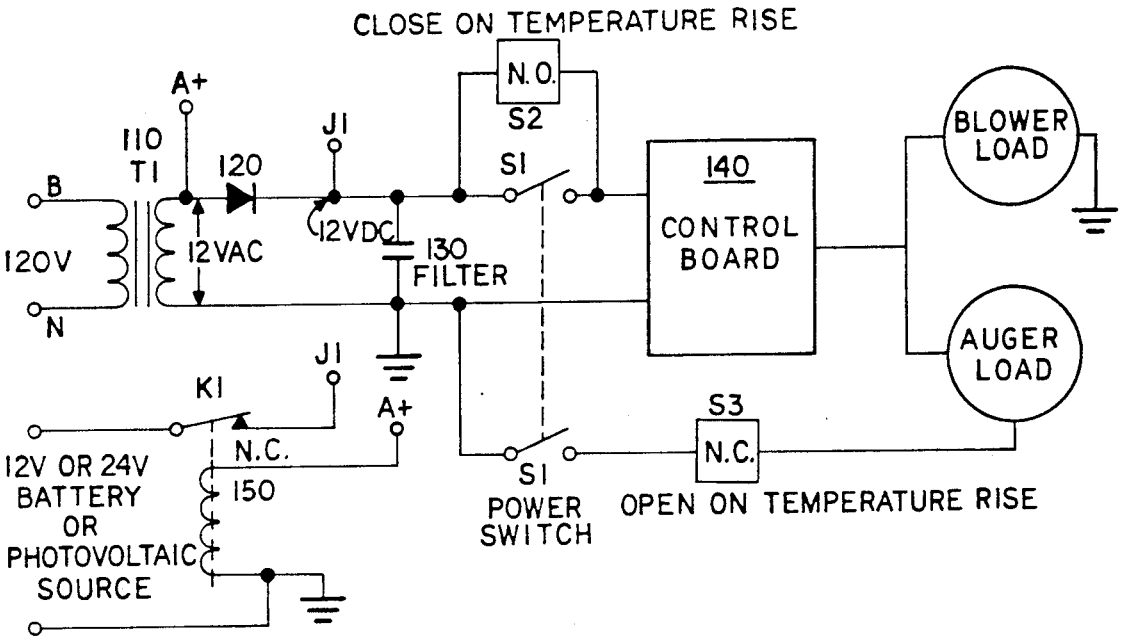
FIGS. 7 and 8 are two wiring diagrams illustrating a unique electric circuit of the present invention.
Figure 8:
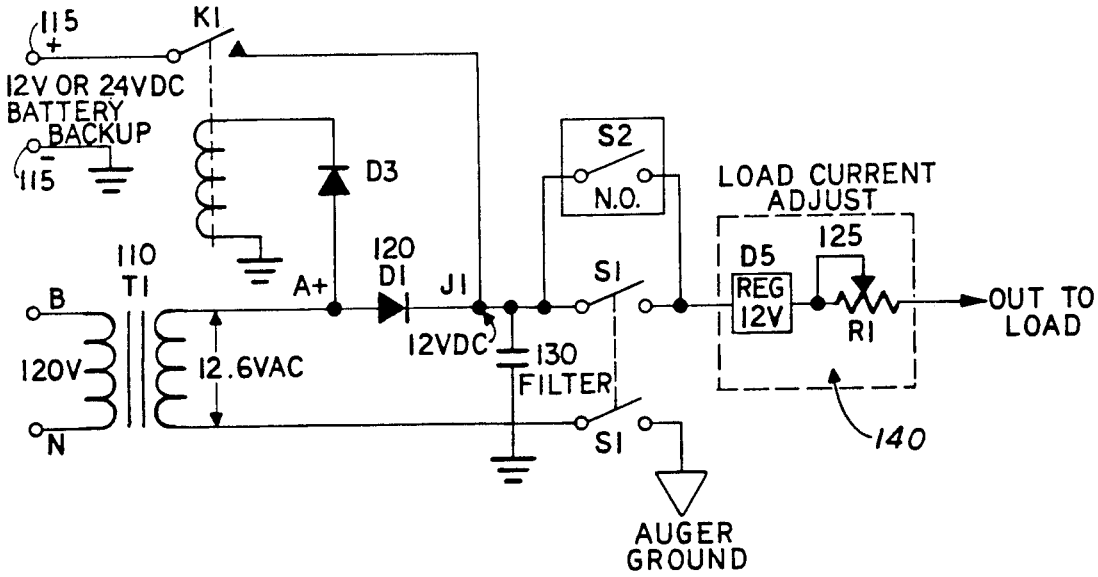

FIGS. 7 and 8 show an electric circuit for powering fan 17 and auger mechanism 29. This circuitry is unique in that it permits the use of either AC, battery, or photovoltaic power to operate fan 17 and mechanism 29. Because of low power requirements, the device can use either stepped down, transformed AC, DC battery, or photovoltaic power. This circuit is also very important in that it drives a more efficient load, drawing very little power. Stated alternatively, the benefit of reduced load requirement derived from this design permits the use of various low power sources. Because of the increased ease of air flow through stove 10, the power requirement is reduced and only one circulation fan 17 is needed.

The circuit takes advantage of the above described construction for the stove and reflects these unique features. Thus, whereas prior-art stoves required 200 watts of power or 2 amps of AC at 120 volts, the present stove requires a mere 25 watts maximum of DC power or 250 milliamps of AC. One reason for this reduced power requirement is that as shown, air-pressurized fuel storage area 12 communicates directly with (a) combustion chamber 21, (b) heat exchanger manifold 62, (c) central heat exchanger pipe 43, and (d) draft-enhancing pipe 18*a*, eliminating a maze of duct work. Thus, air flow resistance is reduced so that a single fan 17 can move air through the stove, whereas prior-art stoves required several fans and/or a high wattage blower. More specifically, the circuitry and power are required merely to energize a solitary fan motor and auger mechanism for feeding pellets.

As shown in FIG. 7, a step-down transformer 110 reduces conventional alternating current from 120 volts to approximately 12 volts AC. This signal is thereafter converted to DC by diode 120. This voltage is thereafter filtered via capacitor 130 and regulated via a 12-volt regulator contained within control board 140 (FIG. 8) which provides a constant working voltage circuit regardless of current load. A power rheostat 125 (R1) adjusts power to loads and is accessible via knob 126 (FIGS. 3 and 8).

A further power source is disposed in parallel to the conventional 120 volt AC source. This supplemental source can be in the form of either a battery and/or photovoltaic source. A "parasitic" solenoid relay 150 (FIG. 8) includes a normally open relay K1 so long as power is provided via the AC power source. Failure of this source, however, enables the battery and/or photovoltaic backup. In essence, both FIGS. 7 and 8 reflect identical features thus far discussed with minor modifications with respect to circuit control via diodes D1 and D3 (FIG. 8). Control board 140 has a regulator to regulate the 12 volts DC in combination with a power rheostat manually adjusted in response to consumer comfort via knob 26. Various safety features with respect to this stove can now be discussed in light of the circuitry.

The stove's ventilation system is "self-priming". The effect of this self-priming feature means that the ventilation geometry has been calculated to evacuate exhaust gases safely even without use of fan 17. Thus, natural air flow will safely sustain the stove. Additionally, however, a plurality of thermal "snap" switches S-2 and S-3 are provided in the circuit at strategic locations to be enabled in the presence of a temperature profile monitored at strategic points in the stove. These switches are activated only when the temperature is outside a certain range. Thus, FIG. 7 shows a pair of snap switches S-2 and S-3 disposed in parallel, with one switch S-2 providing energy to one leg of regulator control board 140, and the other switch S-3 supplying a ground to the auger. When a fire is started, power switch S-1 is closed. As the temperature rises such that the temperature at switch S-2 exceeds 150° F., for example, switch S-2 (which is normally open) closes and will override switch S-1 until the system cools below 150° F. Conversely, when switch S-3 senses excessive temperatures (e.g., greater than 300° F.) S-3 (which is normally closed) will open and disable the auger until the temperature drops. This in effect assures protection of the fuel in the hopper, auger drive, and control circuit. FIG. 6 especially denotes the location of the control board on bottom wall 11 below hopper 19 and adjacent fan 17. This assures the coolest of temperatures in the stove. Switches S-2 and S-3 pass through wall 40, separating chamber 21 from the top portion of the hopper area.

CONCLUSION, RAMIFICATIONS AND SCOPE

It can be seen that because the stove's pressurized fuel storage area communicates directly with the combustion chamber, heat exchanger, and draft enhancing pipe, airflow is improved, and fan electrical power and overall stove electrical power consumption is kept to a minimum.

Many modifications may be made without departing from the basic spirit of the invention. For example, note water line 46 (FIGS. 5, 6) passing from rear wall 13, between top wall 15 and 50 and into combustion chamber 21. This line will provide hot water via heat exchange. Accordingly, it will be appreciated by those skilled in the art that within the scope of the appended claims and their legal equivalents, the invention may be practiced other than has been specifically described herein.

We claim:

1. A stove for converting fuel to heat, comprising:

(a) means defining a fuel storage area;

(b) means for pressurizing said fuel storage area, said means comprising a single air blowing means;

(c) means defining a combustion area for allowing combustion to take place;

(d) vent means for venting air from said combustion area;

(e) means defining a heat exchange area adjacent to and in contact with said combustion area for removing heat from said combustion area; and (f) means for conducting pressurized air from said fuel storage area directly to said combustion area and directly to said heat exchange area, thereby to minimize resistance to air flow and the amount of power needed to move air through said stove.

2. The stove of claim 1 wherein said air blowing means is an electrically powered fan.

3. The stove of claim 2 further including;

(a) means for supplying an alternating current to said stove and rectifying said alternating current to direct current;

(b) means for supplying said direct current to said fan;

(c) a battery source of direct current;

(d) means for automatically selecting said battery source of direct current source when alternating current is unavailable.

4. The stove of claim 1, further including a cooking surface, allowing said means for cooking surface to be removed for the purpose of cleaning the interior of said stove and means for sealing said cooking surface to atop of stove so as to prevent exhaust gasses from entering the area outside of said stove.

5. A stove for converting fuel to heat, comprising:

(a) a housing containing a combustion chamber for burning fuel to create heat, (b) vent means for venting air from said combustion chamber, (c) means defining a heat exchange area adjacent to and in contact with said combustion chamber for removing heat from said combustion chamber, and (d) air movement means for forcing air through said combustion chamber, said air movement means being arranged to convert direct current electrical energy to mechanical energy which forces said air through said combustion chamber, whereby said stove can operate from a battery or other direct-current source, permitting said stove to operate reliably in areas or circumstances where alternating current power sources are unreliable or unavailable.

* * * * *